US008216092B2

(12) United States Patent
Wennesland

(10) Patent No.: US 8,216,092 B2
(45) Date of Patent: Jul. 10, 2012

(54) GOAL DEVICE FOR TEAM GAMES

(75) Inventor: Anders Alf Wennesland, Maroussi (GR)

(73) Assignee: Parklife Innovations Ltd. (GB)

( * ) Notice: Subject to any disclaimer, the term of this patent is extended or adjusted under 35 U.S.C. 154(b) by 319 days.

(21) Appl. No.: 12/631,487

(22) Filed: Dec. 4, 2009

(65) Prior Publication Data

US 2011/0105253 A1 May 5, 2011

(30) Foreign Application Priority Data

Nov. 2, 2009 (NO) ..... 20093269

(51) Int. Cl.
*A63B 63/00* (2006.01)

(52) U.S. Cl. ..... 473/478

(58) Field of Classification Search ..... 473/478; 135/74, 69; 16/260, 262; 114/361; 403/3, 403/61, 72, 92, 102; 42/94; 5/626; 81/53.1
See application file for complete search history.

(56) References Cited

U.S. PATENT DOCUMENTS

| | | | | | |
|---|---|---|---|---|---|
| 793,576 | A * | 6/1905 | Follmer | 135/74 |
| 957,734 | A * | 5/1910 | Bratzel | 135/74 |
| 980,227 | A * | 1/1911 | Ely | 135/74 |
| 1,136,167 | A * | 4/1915 | Reininger | 135/74 |
| 3,161,973 | A * | 12/1964 | Hastings | 40/591 |
| 4,068,846 | A * | 1/1978 | Forrest | 473/439 |
| 4,116,446 | A * | 9/1978 | Thompson | 473/197 |
| 5,178,583 | A * | 1/1993 | Rankin | 464/114 |
| 5,413,340 | A * | 5/1995 | Potvin et al. | 273/127 B |
| 5,577,799 | A * | 11/1996 | St. Germain | 297/35 |
| 5,681,045 | A * | 10/1997 | Liao | 273/400 |
| 6,371,873 | B1 * | 4/2002 | Wang | 473/478 |
| 2011/0105253 | A1 * | 5/2011 | Wennesland | 473/478 |

FOREIGN PATENT DOCUMENTS

| | | |
|---|---|---|
| GB | 2336322 | 6/2002 |
| WO | 2004091737 | 10/2004 |

* cited by examiner

*Primary Examiner* — Gene Kim
*Assistant Examiner* — M Chambers
(74) *Attorney, Agent, or Firm* — Kolisch Hartwell, P.C.

(57) ABSTRACT

A construction for a goal for a team game, especially a soccer goal, and more particularly a mini goal for soccer and football training, wherein the construction comprises two vertical pole elements connected to a completely or partially hollow cross bar element through two corner joints, said corner joints being able to be placed inside the at least partially hollow horizontal cross bar element, and said corner joints being hinged for leading the vertical pole axis to a position wherein the pole elements of the vertical pole elements mainly coincide with the pipe axis of the at least partially hollow horizontal cross bar element, and wherein the vertical pole elements may be passed substantially completely inside the at least partially hollow horizontal cross bar element. Such a construction may be compacted into an easily transportable form of said goal.

10 Claims, 2 Drawing Sheets

GOAL DEVICE FOR TEAM GAMES

The present invention concerns a construction for goals for team games, particularly soccer goals and especially mini goals for soccer and soccer practice, said construction comprising two vertical pole elements connected to a hollow horizontal pole element through two corner pieces which may pass inside the hollow horizontal pole element, and said corner pieces being hinged for passing the vertical pole elements to a position where the pole axis of the vertical pole elements substantially coincide with the pole axis of the hollow horizontal pole element, and wherein the vertical pole elements may be passed substantially completely into the hollow horizontal pole element. In a particular embodiment the goal construction according to the invention comprises two additional pole elements being connected to the vertical pole elements through a movable joint, said movable joint optionally supporting further pole elements to lie with their pole axis from mainly coinciding (0°) to an angle of 180° and preferably between 45° and 135°, e.g. about 90° to the pole axis of the vertical pole elements. In a further particular embodiment the additional pole elements may be placed horizontally in an angle to the first horizontal pole element, where said angle preferably is 90°. In yet another embodiment the goal construction according to the invention may comprise a sixth pole element being hollow and being connected to the additional horizontal pole elements through an adjustable connecting joint, said sixth pole element being able to contain the additional horizontal pole elements. In yet another embodiment said sixth pole element may comprise a hinged joint, said hinged joint contributing to the length of a sixth pole element being longer than the length of said first horizontal pole element. In such an embodiment each individual part of said sixth pole element being capable of being passed telescopically into each other, optionally together with the hinge joint(s).

BACKGROUND FOR THE INVENTION

Team sports or games being carried out on skates (ice hockey, bandy) and especially ball games being performed on the ground level such as soccer, hand ball, etc. requires a goal inside which the ball is to be placed to win the game. In many locations, however, there are no permanently erected goal constructions because the relevant area is also used for other activities such as athletic sports, so that a permanent goal would hamper such activities, or the activity is seasonal (ice hockey, out-door soccer, mini-soccer, etc.) so that the goal construction should be demountable. When storing goal parts one concern is also that such parts should not occupy too much space in the holding area. Consequently there exists a need for collapsible, transportable and non-permanent goal constructions that may be demounted after an ended game or after an ended season.

PRIOR ART

It is from GB patent application 2 336 322 A previously known a collapsible goal construction consisting of two vertical parts (poles) and a horizontal part (cross bar) wherein the parts are mounted separately. Such a goal construction is, however, relatively distant from the present construction since the common feature here is that the goal comprises two uprights a cross bar, as all goals need to have (some goals lack admittedly a cross bar, but this makes it difficult to calculate if a goal has been scored if there is a question abut a high ball).

From WO 2004/091737 A1 there is known to equip a goal device with flaps for promoting an advertisement. However, it is here not mentioned anything about the pole construction per se.

GENERAL DISCLOSURE OF THE INVENTION

The present invention will be disclosed infra under reference to the accompanying figures wherein.

Figure 1:
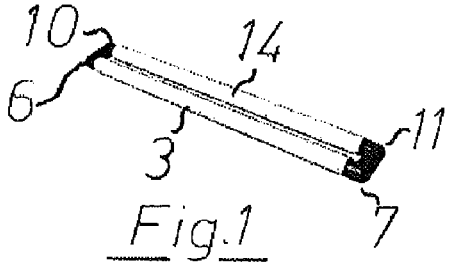
FIG. 1 shows an embodiment of the goal construction according to the present invention in a folded position.

A collapsible goal construction according to the present invention comprises in its simplest embodiment two pole elements 1,2 with a hollow cross bar element 3 into which the upright pole elements 1,2 may be passed. The upright pole elements 1,2 are connected to the cross bar element 3 trough hinged joint elements 4,5 which also may be passed into the hollow cross bar element 3. The hinge elements 4,5 are jointed in such a way that they my pass the upright pole elements 1,2 from a position wherein the axis of the upright pole elements mainly coincide with the axis of the cross bar element 3 to a position that mainly corresponds to a position wherein the axis of the upright pole elements run mainly perpendicularly to the axis of the cross bar element 3.

All pole and pipe elements in the goal construction according to the present invention may be compact or completely or partly hollow as long as their basic functions (e.g. the entering of the pole elements 1,2 and the hinged joints 4,5 into the cross bar element 3) are ensured. It is preferred that the pipe elements in the goal construction according to the present invention are completely or partly hollow, this inter alia on account of the weight reduction that is obtained if the pipe elements are hollow. However, a weight reduction may also be obtained if all or some of the parts of he pole/pipe elements in the construction are made of light materials such as plastic or aluminum, in which case a sufficient rigidity of the construction may be obtained by letting all or some of the parts of the construction be massive. Such selections of the construction versus choice of massiveness/hollowness of each part of the construction may be done by the person skilled in the art.

Furthermore, all or some of the pole or pipe elements may be telescoping. This for optionally making the goal construction according to the present invention as compact as possible and/or to be able to vary the size of the upright goal construction and/or to be able to stabilize the upright construction according to the present invention. If the pipe/pole elements of the goal construction according to the invention are telescoping, it is preferred to equip such pipe/pole elements with devices that may lock them in their intended positions. Such possible positions may be completely compacted, partly compacted or completely elongated. One possible alternative locking device may be internal expansion elements expanding when the inner and outer pipe elements are rotated axially relative to each other. Such expand locking devices may also make it possible to lock the length of the relevant pipe/pole element in any expanded or compacted position. Another alternative locking device may be to equip the outer or inner pipe element in the telescoping assembly with holes, and the adjacent inner or outer pipe element with corresponding pegs pressed against the respective sliding element so that the peg pops into a passing locking hole when this passes by and thereby locking the relevant pipe/pole element reciprocally. Such a locking device will make the locking function stepwise. A third alternative locking function may be simply to equip the relevant telescoping pipe/pole element with reciprocal holes so that a locking bolt may be passed through said holes when they coincide with each other.

If all or some pipe elements in the goal construction according to the present invention are telescoping or may pass into each other, such pipe elements (e.g. the cross bar element 3 and the upright pole elements 1,2, see infra) may in one embodiment alternatively be equipped with internal pulling elements such as elastics and/or spiral springs so the such telescoping elements are drawn into each other as soon as their axis are mainly coinciding.

In the simple embodiment of the goal device according to the present invention, and being explained initially supra, the ends of the upright pole elements 1,2 being distant from the cross bar element 3 in an upright position, may be equipped with pegs or feet (not shown) to make it possible to place erected goal construction in a safe way, e.g. by pressing such pegs into the ground. Alternatively the upright poles may themselves be pressed into the ground if they are able to withstand such a strain.

In an alternative embodiment the goal construction according to the present invention may be equipped with a hinged joint device 6,7 in the part of the upright pole elements that face away from the cross bar element 3. Such a hinged joint element 6,7 may be connected to further pipe elements 8,9 that may be moved to lie perpendicularly to the upright pole elements 1,2 as well as in an angle to the cross bar element 3. The hinged joint elements 6,7 may in such an embodiment be equipped with a hinge function that may cause the axis of the pipe elements 8,9 to run parallel to or at least at an angle to the axis of the upright pole elements 1,2. Preferably the angle interval that this hinged joint element 10,11 spans will be 0-90°, most preferred 90°. These hinged joint elements 6,7 will also comprise a smaller area 12,13 the dimension of which between the pivoting function for the hinged joint 10,11 and the joint 6,7 will correspond to a pipe diameter of the pole elements 1,2 so that the pivoting of the pip element 8,9 does not affect the placement of the pole elements 1,2. In an alternative embodiment the hinged joints 6,7 may be invariably 90° and the hinges 10,11 may be pivoted between 0 and 90°. The pipe elements 8,9 will in this embodiment form the whole or apart of the foundation area for the goal construction according to the present invention. If the length of the pipe elements individually equals the length of the cross bar element, the foundation area of the goal construction according to the present invention in an upright condition, will form an equal-sided triangle when the tips of the pipe elements 8,9 meet. In such an embodiment the hinged joint elements 6,7 may be pivoted axially in their sockets in the pole elements so that the pipe elements 8,9, when the goal construction according to the present invention is present in a folded condition, may pass on each side of the cross bar element 3. Alternatively the pipe elements 8,9 may be telescoping so that their combined lengths correspond to or is less than the length of the cross bar element 3, in which case the pipe elements 8,9, when they are present in a compacted state, may pass on the same side of he cross bar element 3.

Figure 2:
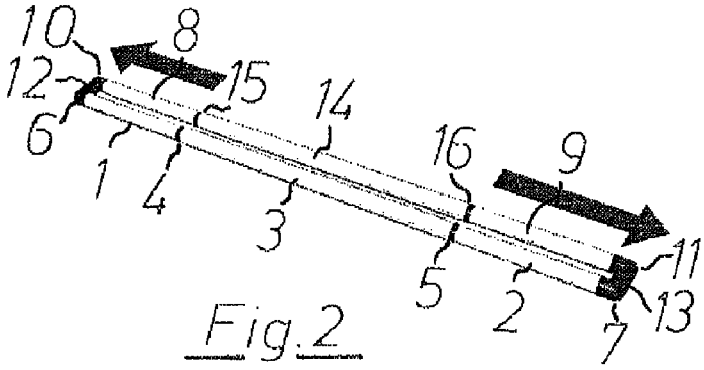
FIGS. 2-4 show an assembly sequence of the embodiment of the goal construction accord to the present invention.
Figure 3:
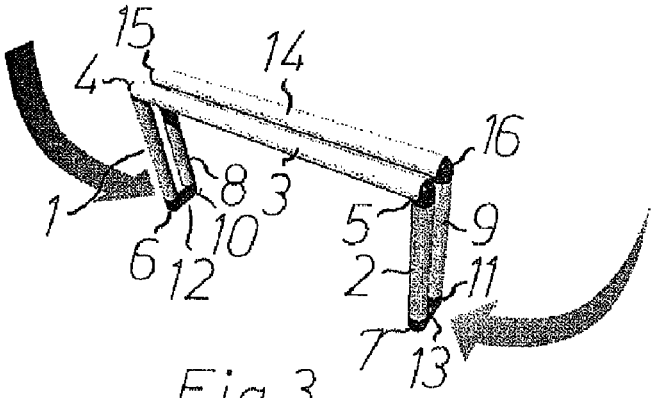
Figure 4:
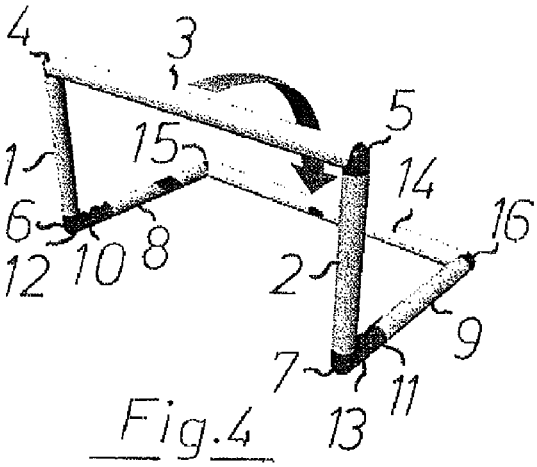

In yet another alternative embodiment the goal construction according to the present invention may comprise an additional pipe element 14 (the parallel element) running parallel to the cross bar element 3 and being connected to the pipe elements 8,9 through hinged joints 15,16. The hinged joints 15,16 may function over an angle interval between 0° (the axis between the pipe elements 8,9 and the parallel element 14 coincide with each other, FIG. 2) and 150°, and preferably between 0° and 90° (FIG. 3-4). The length of the parallel element 14 is random (the parallel element 14 may be telescoping), but in one embodiment it is preferred that the length of the parallel element corresponds to the length of the cross bar element 3.

Figure 6:
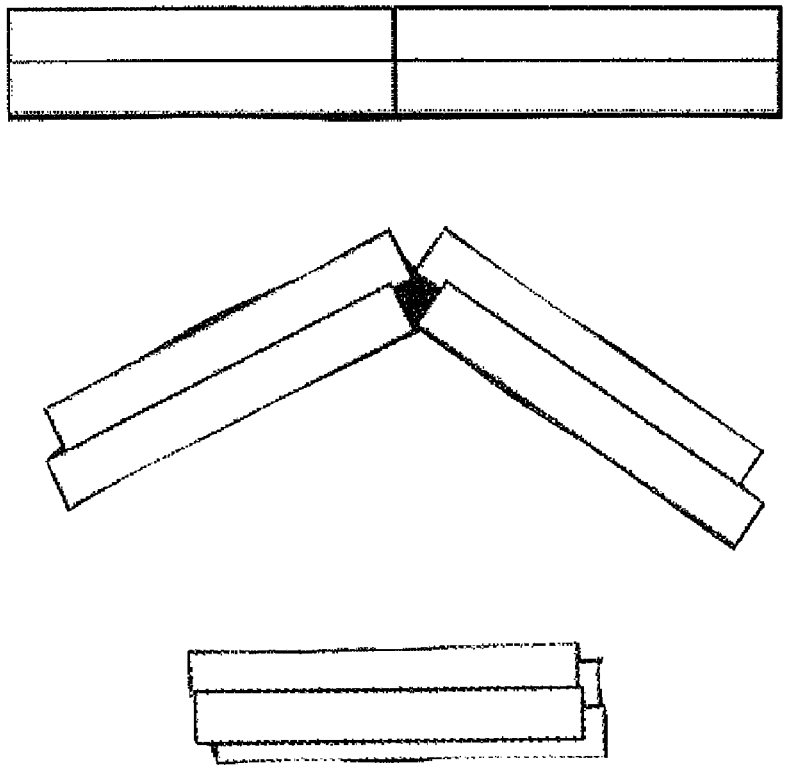
FIG. 6 shows an alternative design of the goal construction according to the present invention.

In a further alternative embodiment the cross bar element 3 and the parallel element 14 may be jointed so that they may be folded (see FIG. 6). Since the upright pole elements 1,2 and the pipe elements 8,9, when the goal construction according to the present invention is compacted, lie with their internal ends against each other, it will be possible to make the goal construction according to the present invention even more compact by folding the cross bar element 3 and the parallel element 14 towards each other. If such an alternative is relevant, the cross bar element 3 and the parallel element 14 may be equipped with an internal peg (not shown) so that the halves thereof that may be folded towards each other, in an assembled condition may be braced in the joint area by the halves being pressed over their respective pegs thereby forming a stiff joint.

Figure 5:
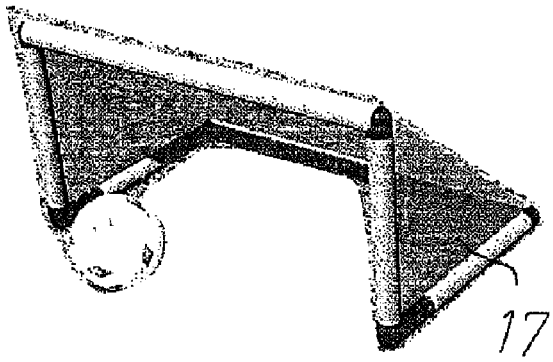
FIG. 5 shows a goal construction of the embodiment shown in FIGS. 1-4 in an upright position.

The goal construction according to the present invention has been presented supra as possible embodiments of the pipe and pole elements forming the goal construction. For making a preferred goal construction there may be mounted to or be mounted between the pipe and pole elements a netting material, cloth, plastic netting or similar structure 17 (see FIG. 5) for making a complete goal construction. It may also be possible to have such a goal netting rolled up inside one or more of the pipe elements in the goal frame, or it may also be possible to mount such a netting material secure to the goal construction according to the invention after the goal frame has been erected. In the depicted embodiment in FIGS. 1-5 it may be possible to have such a netting material 17 permanently secured to the cross bar element 3 and the parallel element 14, and have the side surfaces of the netting material 17 loose so that the goal frame may be folded as explained without the netting element disturbing the folding process of the goal frame as explained supra.

The disclosure above has been presented with reference to the notion of "pipes", "poles", "pipe elements" and "pole elements". In this connection it will be presented that this notion comprises all types of cross-sectional forms of such elements. The cross-sectional forms of the pole or pipe elements may thus e.g. be square, hexagonal or circular, even if a circular cross-sectional form is preferred.

In the disclosure supra there has also been used specifications such as "substantially" or "mainly" or corresponding formulations. In the present connection such notions mean there is a certain "leeway" in the relevant sizes, and it is the function of the component to which it is referred that is decisive. The notion "mainly" or "substantially" thus includes a discrepancy interval of up to ±10% of the indicated size, more preferred up to ±5% and even more preferred up to ±1%.

The invention claimed is:

1. A goal for a team game, comprising two vertical pole elements connected to a completely or partially hollow cross bar element through two corner joints, said corner joints being configured to be placed inside the at least partially hollow horizontal cross bar element, and said corner joints being hinged for leading the vertical pole axis to a position wherein the pole elements of the vertical pole elements mainly coincide with the pipe axis of the at least partially hollow horizontal cross bar element, and wherein the vertical pole elements may be passed substantially completely inside the at least partially hollow horizontal cross bar element.

2. The goal according to claim 1, wherein the vertical pole components are equipped with pegs at their external ends.

3. The goal according to claim 1 or 2, further comprising two additional pole elements, each being connected to a vertical pole element through a movable joint, said movable joints being able to pass the additional pole elements to lie with their pole axes from mainly coinciding (0°) to an angle of 180°.

4. The goal according to claim 3, wherein the additional pole elements may be placed horizontally at an angle to the first horizontal cross bar element.

5. The goal according to claim 4, wherein the goal comprises a sixth pole element which is at least partially hollow and being connected to the additional horizontal pole elements through adjustable connecting joints, said sixth pole element being configured to at least partially enclose the additional horizontal pole elements.

6. The goal according to claim 5, wherein the sixth pole section comprises at least one hinged joint, said hinged joint contributing to the length of the sixth pole element being capable of being longer than the length of said first horizontal cross bar element.

7. The goal according to claim 1, wherein the goal is configured to be used as a soccer goal.

8. The goal according to claim 3, wherein said movable joints are configured to pass the additional pole elements to lie with their pole axes at an angle of between about 45° and about 135° to the pole axes of the vertical pole elements.

9. The goal according to claim 8, wherein said movable joints are configured to pass the additional pole elements to lie with their pole axes at an angle of about 90° to the pole axes of the vertical pole elements.

10. The goal according to claim 4, wherein the additional pole elements may be placed horizontally at an angle of about 90° to the first horizontal cross bar element.

* * * * *